United States Patent [19]

Dellinger et al.

[11] Patent Number: 5,072,214

[45] Date of Patent: Dec. 10, 1991

[54] ON-SCREEN DISPLAY CONTROLLER

[75] Inventors: Charles E. Dellinger; John C. Pryzbyszewski, both of Knoxville; Donald B. Wolter, Gatlinburg, all of Tenn.

[73] Assignee: North American Philips Corporation, New York, N.Y.

[21] Appl. No.: 350,826

[22] Filed: May 11, 1989

[51] Int. Cl.[5] ..... G09G 1/14

[52] U.S. Cl. ..... 340/750; 340/734; 340/735

[58] Field of Search ..... 340/731, 734, 750, 735, 340/721; 358/22, 183

[56] References Cited

U.S. PATENT DOCUMENTS

| | | | |
|---|---|---|---|
| 3,624,632 | 11/1971 | Ophir | 340/324 A |
| 3,996,584 | 12/1976 | Plager | 340/735 X |
| 4,357,604 | 11/1982 | Imazeki et al. | 340/731 |
| 4,555,191 | 11/1985 | Gojo | 340/735 X |
| 4,682,161 | 7/1987 | Bugg | 340/755 X |
| 4,742,344 | 5/1988 | Nakagawa et al. | 340/750 X |
| 4,755,814 | 7/1988 | Olsen | 340/750 X |
| 4,868,554 | 9/1989 | Aoki et al. | 340/735 |

OTHER PUBLICATIONS

"IBM Technical Disclosure Bulletin", vol. 23, No. 8, Jan. 1981, pp. 3791-3792.

*Primary Examiner*—Ulysses Weldon
*Attorney, Agent, or Firm*—Edward W. Goodman

[57] ABSTRACT

A character-based display controller, which is capable of providing variable width text characters, includes a ROM embedded with pattern and attribute codes, and a logic control circuit enabling multiple modes of interpreting the data in the character memory. The logic control circuit also enables bypassing the character memory thereby permitting a bit-mapped display mode.

6 Claims, 6 Drawing Sheets

FIG. 4a
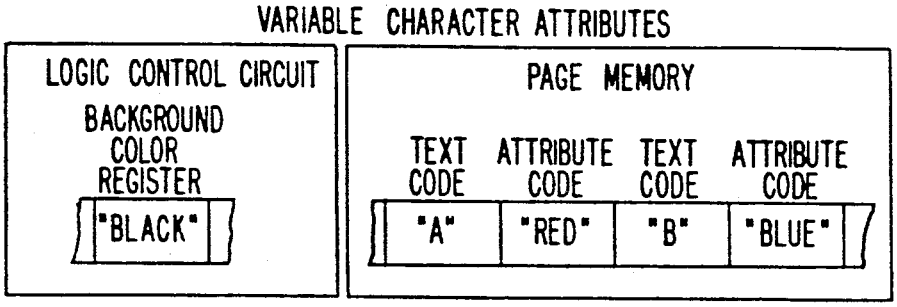
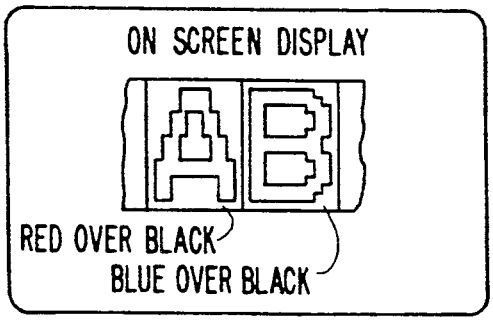
FIG. 4b
FIG. 4c
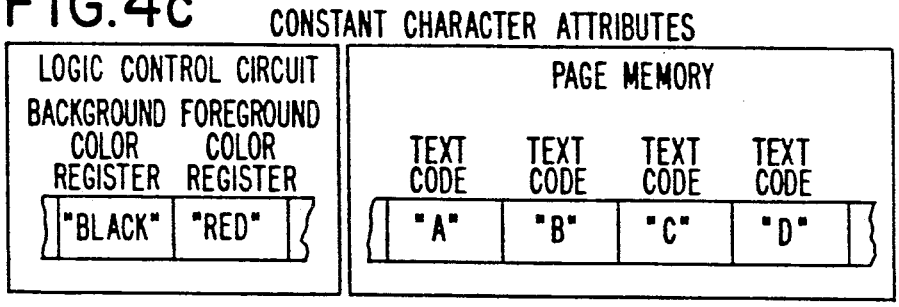
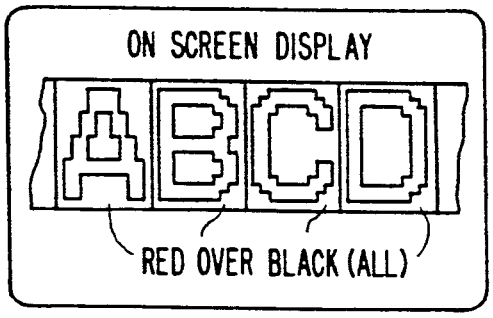
FIG. 4d

ON-SCREEN DISPLAY CONTROLLER

BACKGROUND OF THE INVENTION

1. Field of the Invention

The subject invention is related to display controller used in products containing CRT displays to superimpose text or other graphics images on a video signal.

2. Description of Related Art

There are generally two types of display controllers, namely, character-based and bit-mapped. The character-based display controllers derive economy of implementation compared to the bit-mapped display controllers by using a relatively small digital page memory (RAM) which contains a series of codes, each of which specifies a previously defined text character image. The array of text characters is generated in raster format by means of a mapping procedure in which the text character codes are used to look up the serial bit patterns in a digital character memory (ROM). Each text character pattern in the character memory is typically a small bit-mapped pattern which generates a window in the page display of fixed rectangular size.

SUMMARY OF THE INVENTION

An object of the present invention is to provide a display controller which economically provides text and text based graphic images for a CRT display in a television receiver which are easier to read and more visually attractive than those provided by prior art systems.

The above object is achieved in a display controller of the above type, wherein the display controller comprises means for providing variable width text characters, a ROM containing pattern and attribute codes, means for providing multiple modes of character memory interpretation, means for optionally bypassing the character memory, and means for line-by-line modification of control registers in the logic control circuit.

BRIEF DESCRIPTION OF THE DRAWINGS

With the above and additional objects and advantages in mind as will hereinafter appear, the subject invention will be described with reference to the accompanying drawings, in which:

FIGS. 4*a* and 4*b* show the codes and the resulting display when the page memory stores a text code and an attribute for each character, while FIGS. 4*c* and 4*d* show the codes and the resulting display when the attributes for all characters in a horizontal row are stored in registers separate from the page memory;

DESCRIPTION OF THE PREFERRED EMBODIMENT

Figure 1:
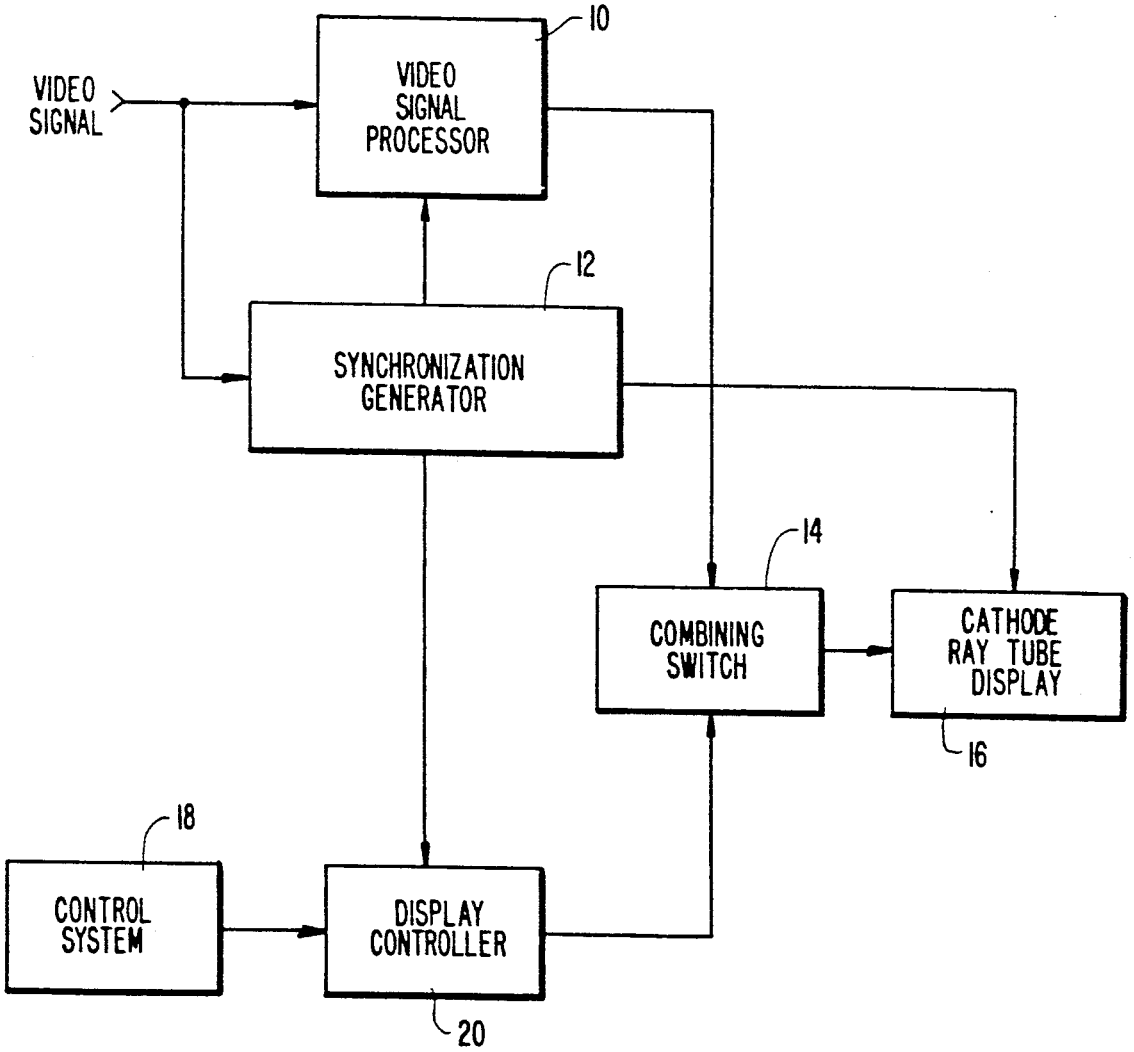
FIG. 1 PRIOR ART
FIG. 1 is a block diagram of a typical system in which a display controller is incorporated.

FIG. 1 shows a block diagram of a typical system using a display controller. The system includes a video signal processor 10 for receiving and processing a video signal. The video signal is also applied to a synchronization signal generator 12 which strips the synchronizing signals from the video signal and applies timing signals to the video signal processor 10. An output of the video signal processor 10 is applied to a combining switch 14, the output of which is applied to a CRT display 16 which receives synchronizing signals from the synchronization signal generator 12. When graphics are desired, a control system 18 applies control signals to a display controller 20, which receives timing signals from the synchronization signal generator 12. An output of the display controller is applied to another input of the combining switch 14.

Figure 2:
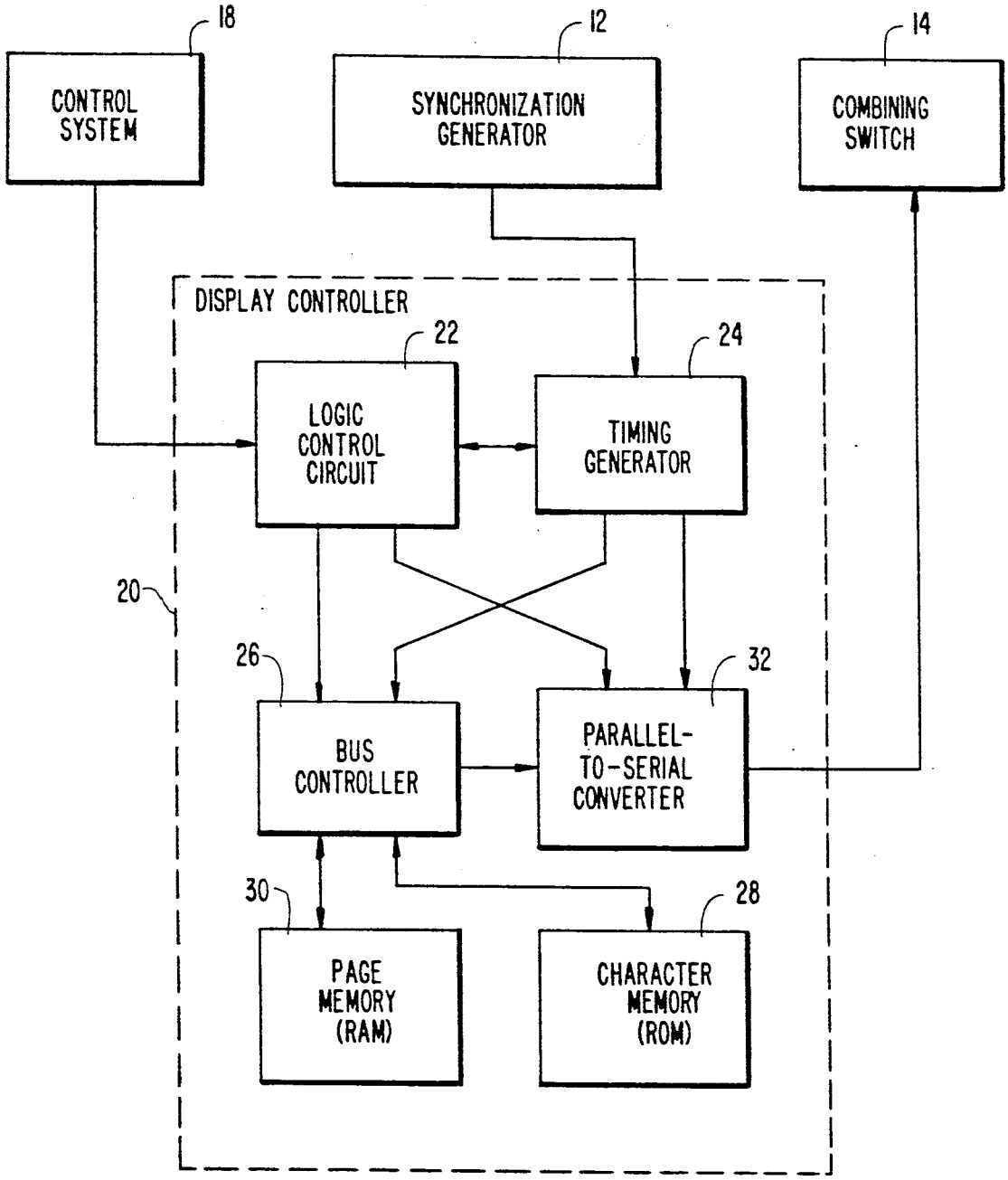
FIG. 2 is a block diagram of a character-based display controller.

As shown in FIG. 2, the display controller 20 includes a logic control circuit for receiving the control signals from the control system 18 and a timing generator 24 coupled to the logic control circuit 22 and which receives the timing signals from the synchronization signal generator 12. Respective outputs of the logic control circuit 22 and the timing generator 24 are coupled to a bus controller 26 which is in communication with a character memory ROM 28 and a page memory RAM 30. An output of the bus controller 26 is coupled to a parallel-to-serial converter 32 which receives control signals from the logic control circuit 22 and timing signals from the timing generator 24. An output of the parallel-to-serial converter 32 is coupled to the combining switch 14.

Figure 3A:
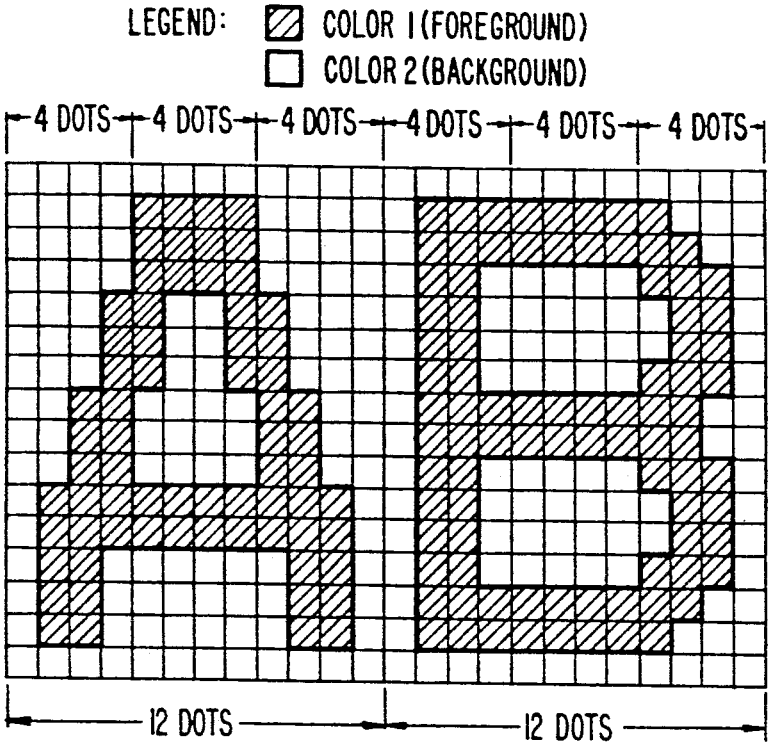
FIGS. 3*a* and 3*b* show illustrations of pattern windows with variable width text characters.
Figure 3B:
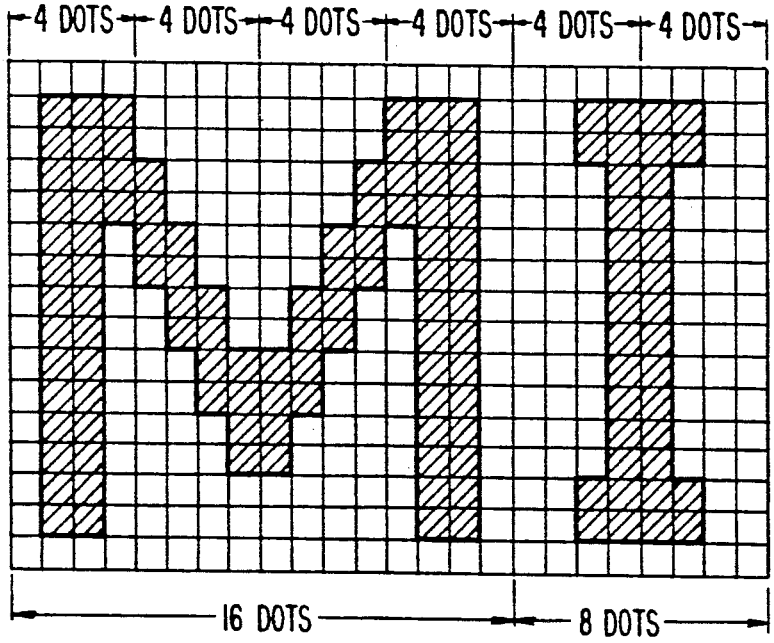

Variable width text characters are produced by making the size of the pattern window corresponding to each pattern in the character memory ROM 28 a fraction of the width of an average text character. For example, if the width of a typical text character is twelve dots, and the pattern window width is four dots, then each text character is typically a mosaic concatenation of three primitive pattern elements. Wide text characters, such as "M" and "W", which are 16 dots wide, may be formed by concatenating four primitives, while narrow text characters, such as "I" and "1", which are eight dots wide, may be formed by concatenating two primitives. FIG. 3 illustrates this concept. In addition to the look-up procedure used to convert the stored patterns to raster-format serial signals, as directed by the codes stored in the page memory, a second look-up procedure is used to simplify the mosaic assembly of the primitives. As an example, consider the 36 alphabetic and numeric text characters A B C D E F G H I J K L M N O P Q R S T U V W X Y Z 0 1 2 3 4 5 6 7 8 9. Two characters, "I" and "1", are two primitives wide; two characters, "M" and "W", are four primitives wide; and the remaining 32 characters are three primitives wide. The identities of the two, three or four primitives for a particular character, as well as the number, are contained in a look-up table, which may be conveniently stored in the character memory ROM 28. The index to the look-up table is a simple fixed-format code, similar to the ASCII codes, which can be used in a known manner to economically represent the text or graphics content of a page of information. A series of these codes may then be either communicated to the logic control circuit 22 from the control system 18, or generated within the logic control circuit 22 by an algorithm stored in character memory ROM 28. Then, the logic control circuit 22 performs the look-up procedure as the page memory RAM 30 is loaded with the codes for the primitives. Typically, the number of primitives which must be stored is less than four times the number of text characters. For example, the 36 text characters above can be realized with 80 primitives. Thus, this approach permits a more efficient use of the character memory ROM 28 than a comparable implementation using a fully stored bit-map for each of the 36 text characters, which might require the same memory space as 144 primitives.

Figure 5A:
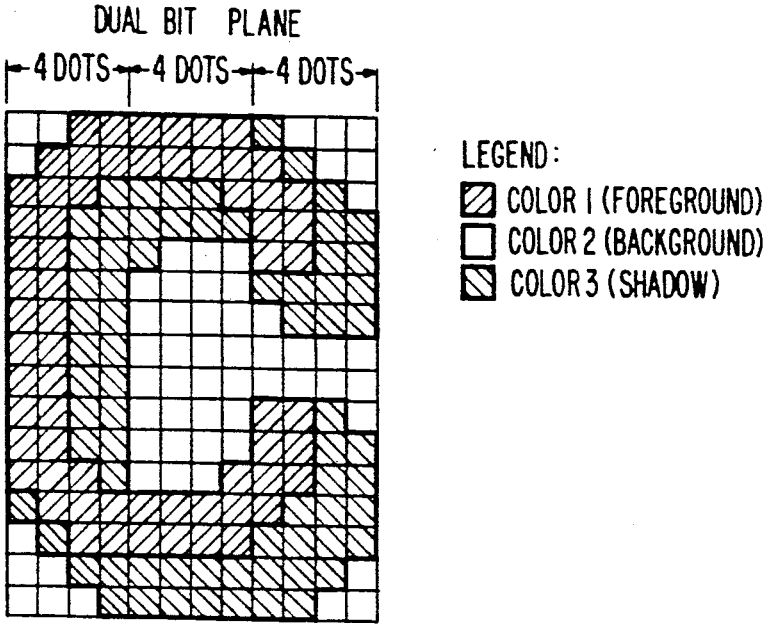
FIGS. 5*a* and 5*b* show two methods for interpreting character memory data for the mode shown in FIGS. 4*c* and 4*d.
Figure 5B:
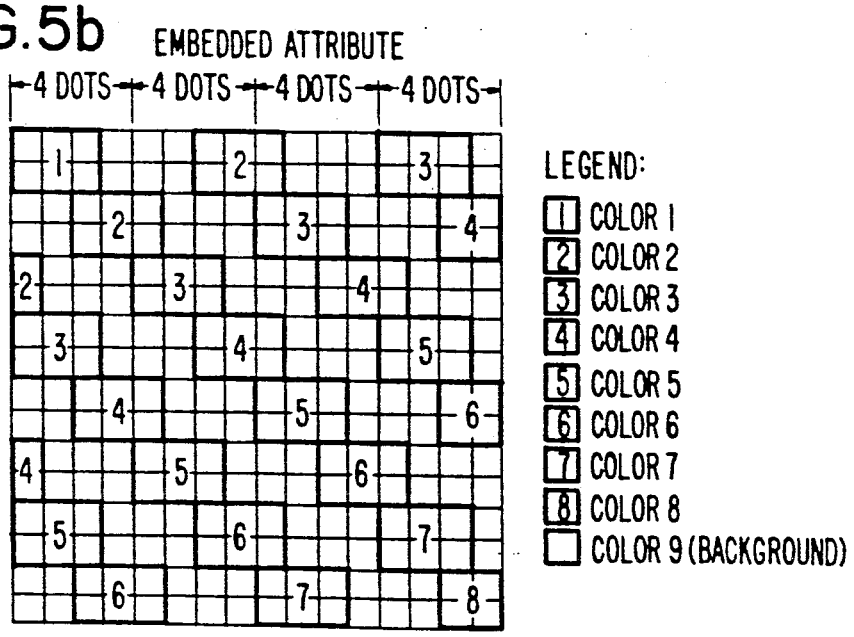

Typically, the page memory RAM 30 is loaded with both the text codes identifying the text characters to be displayed and an attribute code for each text character containing the necessary data to control the colors or intensities of the colors for the particular character. A more economical use of the page memory RAM 30 is obtained if the attribute control information is stored instead in registers separate from the page memory RAM 30, and all characters in the horizontal displayed row are rendered with the same attribute controls. In order to compensate for the reduced flexibility of this approach, a second method for interpretting the data stored in the character memory ROM 28 can also be used. In this alternative method, the attribute (color) control data is embedded in the character memory ROM 28 along with the pattern data for each primitive. Thus, the character memory ROM 28 contains two distinct addressable primitives to render a particular bit pattern in two different colors. While this method does not use the character memory ROM 28 as efficiently, it can be used selectively to restore the flexibility in color control. This method also provides higher resolution of color mapping than the method employing a fixed attribute for each window, since the embedded attributes can be changed, line-by-line, within the window. FIG. 5*b* illustrates the color mapping flexibility which the embedded attribute method permits.

Two modes of character memory interpretation are used in the subject invention. In the first mode, the page memory RAM 30 is loaded with a text code and an attribute code for each displayed text character. In the second mode, the attributes for all characters in a horizontal row are stored in registers separate from the page memory RAM 30, and the data loaded into the page memory RAM 30 is used only to select pattern primitives from the character memory ROM 28. In this second mode, two methods are used to interpret the character memory ROM 30 data. The first method is the embedded-attribute method described above. The second method is the dual bit-plane method, in which two data bits, prescribing up to four states, are assigned to each on-screen dot. This method permits the text to be displayed with drop shadows, or with edges of a contrasting color. FIG. 4 illustrates the two modes of interpretation, while FIG. 5 illustrates the two methods used in the second mode.

The displayed page is conventionally formed by looking up previously defined patterns in the character memory ROM 28. The subject invention uses another optional display mode in which the data loaded into the page memory RAM 30 is processed exactly as if it originated from the character memory ROM 28. This mode is a true bit-mapped display mode, since the look-up procedure is not used. This mode does not offer as efficient use of the page memory RAM 30, but permits the creation of displays which are independent of the contents of the character memory ROM 28.

The subject invention allows control registers within the logic control circuit to be modified while the current page is being refreshed on the screen. These control registers are loaded with the information which controls various selectable characteristics of the display, such as the mode of interpretation of the page memory RAM 30 or the method of interpretation of the character memory ROM 28. Other characteristics controlled in this way include vertical position parameters such as the marginal space at the top of the display, the spaces between rows of text, the marginal space to the left of each row of text, the vertical height of each row of text, and the horizontal or vertical expansion or compression of each row of text. At one point in the time period of each horizontal raster line, the control registers are updated. The set-up time for the new register contents is the entire horizontal time period. This makes the timing of the updating circuitry independent of the other events within the horizontal line period, and, thus, easy to implement. The modifiability of the control registers on a line-by-line basis provides great flexibility in the visual appearance of the displayed pages compared to a display controller in which only page-by-page modifiability is provided. For example, the capability to display text rows of different heights in the same page display, together with the variable-width text character capability, allows a page of text to be easily and economically created which contains two or more sizes of text characters, all of which are displayed at the maximum dot resolution.

Figure 6:
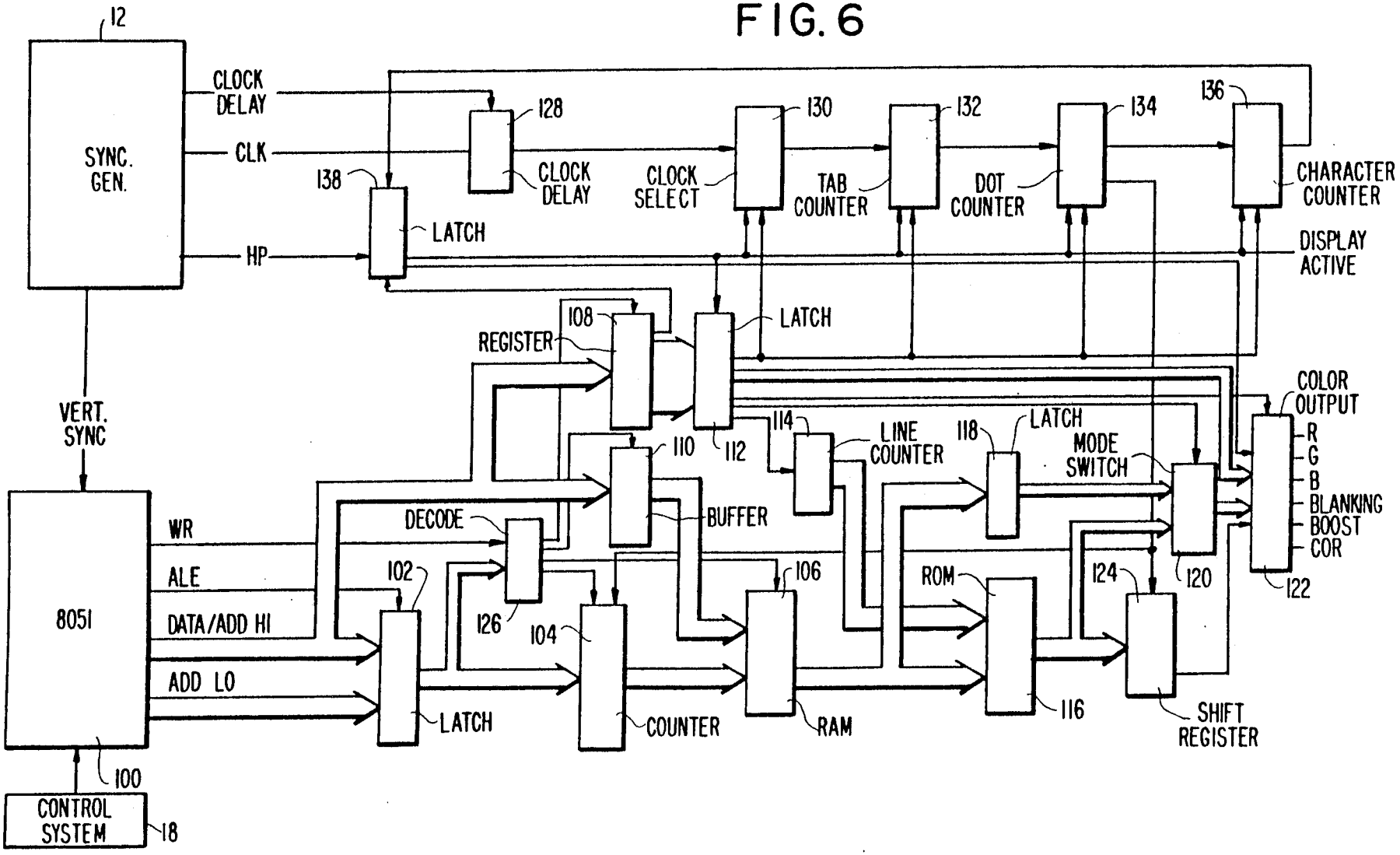
* and FIG. 6 shows a detailed block diagram of the display controller of the subject invention.

FIG. 6 shows a detailed block diagram of a practical embodiment of the display controller 20 of FIG. 2. A microcontroller 100 is arranged to receive the control signals from the control system 18 and a vertical synchronization signal from the synchronization signal generator 12. The microcontroller 100 is an 8-bit control-oriented microcomputer, for example, no. 8051 made by Intel Corporation. The data and low/high address outputs of the microcontroller 100 are connected to a latch 102 which also receives an address latch enable signal from the microcontroller 100. An output of the latch 102 is then coupled to a counter 104, the output of which is coupled to a RAM 106. A register 108 and a buffer 110 further receive the data and low address outputs from the microcontroller 100 and, a latch 112 is coupled to receive the outputs of the register 108. A control signal from the latch 112 is applied to a line counter 114, the outputs of which, along with the outputs of the RAM 106, are applied to a ROM 116. A latch 118 also receives the outputs of the RAM 106, the outputs of which are applied to one set of inputs of a mode switch 120, the other set of inputs of which are connected to the outputs of the ROM 116. The outputs of the mode switch 120 are coupled to a color output circuit 122 which also receives the outputs of the latch 112 along with the output from a shift register 124 which, in turn, receives the outputs of the ROM 116. The output of latch 102 is also coupled to a decoder 126 which applies control signals to the register 108, the buffer 110, the counter 104 and the RAM 106. Clock pulses from the synchronization signal generator 12 are applied to a clock delay circuit 128, an output of which is applied to a mode select 130. An output of the mode select 130 is applied to a series arrangement of a tab counter 132, a dot counter 134 and a character counter 136, each of which receiving a timing signal from the latch 112. Horizontal synchronization pulses from the synchronization signal generator 12 are applied to a latch 138 which supplies a display active signal to the mode select 130, the counters 132, 134 and 136, and latch 112. The latch 138, which is reset by the output of the character counter 136, also has an output applied to an input of the color output circuit 122.

The above-noted elements of FIG. 6 form the components of FIG. 2 as follows: the logic control circuit 22 includes the microcontroller 100, latch 102, register 108, buffer 110, latch 112 and decoder 126; the timing generator 24 includes clock delay 128, clock select 130, tab counter 132, dot counter 134, character counter 136 and latch 138; bus controller 26 includes line counter 111, latch 118 and mode switch 120; character memory 28 includes ROM 116; page memory 30 includes counter 104 and RAM 106; and parallel to-serial converter 32 includes color output circuit 122 and shift register 124.

With regard to the various functions described above as provided by the subject invention, the microprocessor 100, latch 102, counter 104, RAM 106 and ROM 116, form means for enabling the variable width characters; microprocessor 100, latch 102, counter 104, RAM 106, ROM 116, register 108, latch 112 and line counter 114, and alternatively decoder 126 and buffer 110, form means for providing multiple modes of using the data stored in the character memory 28; microprocessor 100, latch 102, counter 104, RAM 106, latch 118, register 108, latch 112 and mode switch 120, form means for selectively bypassing the character memory 28; and microprocessor 100, latch 102, counter 104, RAM 106, ROM 116, register 108, latch 112, latch 138 and decoder 126, form means for line-by-line modification of signals in the logic control circuit 22.

Numerous alterations of the structure herein disclosed will suggest themselves to those skilled in the art. However, it is to be understood that the present description is for purposes of illustration only and is not to be construed as a limitation of the invention. All such modifications which do not depart from the spirit of the invention are intended to be included within the scope of the appended claims.

What is claimed is:

1. A display controller of the character-based type for superimposing text and other graphic images on a video signal, said display controller including a logic control circuit for receiving control signals from a control system for controlling said display controller, a page memory coupled to said logic control circuit for storing text codes and attribute codes for characters in a character set to be displayed, said attribute codes identifying data for controlling colors and intensities of colors for respective characters to be displayed, a character memory having stored therein character data, forming patterns on display corresponding to said characters in said character set, and attribute data for selectively supplying characters with corresponding attributes in response to signals applied to an input thereof, said character memory being coupled to an output of said page memory, and output means coupled to an output of said character memory for supplying the text and other graphic images to be superimposed on the video signal, wherein said display controller further comprises:

means, incorporated in said logic control circuit and said character memory, for enabling variable width text characters to be displayed;

means, coupled between said logic control circuit and said page memory, and between said logic control circuit and said character memory, for providing multiple modes of using the data stored in said character memory;

means, coupled between said page memory and said output means, for selectively bypassing said character memory; and means coupled to said logic control circuit for line-by-line modification of signals in said logic control circuit, said modifiable signals including signals for controlling said means for providing multiple modes of using said character memory data, signals for controlling said means for selectively bypassing said character memory, and signals for controlling a page format of the text on display.

2. A display controller as claimed in claim 1, wherein said means for enabling variable width test characters to be displayed comprises, in said character memory, a size of a pattern window corresponding to each pattern of said character data on display being a fraction of the width of an average text character in said character set, and said character data stored in said character memory being differing patterns appearing in said pattern window, each of said characters in said character set being formed by concatenating various ones of said patterns, thereby reducing the amount of storage necessary for identifying the character set, and in said logic control circuit, a lookup table relating each of the characters in the character set to an appropriate concatenation of said patterns.

3. A display controller as claimed in claim 2, wherein said character set includes 26 alphabetic and 10 numeric text characters in which two of said characters are two patterns wide, another two of said characters are four patterns wide, and the remaining characters in said character set are three patterns wide.

4. A display controller as claimed in claim 3, wherein said logic control circuit includes registers for storing the attribute codes while said page memory only stores said text codes.

5. A display controller as claimed in claim 4, wherein said character memory has embedded therein attribute control data along with said character data, whereby the embedded attributes can be changed line-by-line.

6. A display controller as claimed in claim 4, wherein said means for line-by-line modification of signals in said logic control circuit modifies the contents of said registers while a current page is being refreshed on a display screen on a line-by-line basis, whereby various display parameters may be changed from row-to-row of text.

* * * * *